United States Patent [19]

Ishii et al.

[11] 4,269,286

[45] May 26, 1981

[54] SPEED CONTROL APPARATUS FOR ELEVATOR SYSTEM

[75] Inventors: Toshiaki Ishii; Eiki Watanabe, both of Inazawa, Japan

[73] Assignee: Mitsubishi Denki Kabushiki Kaisha, Tokyo, Japan

[21] Appl. No.: 15,239

[22] Filed: Feb. 26, 1979

[30] Foreign Application Priority Data

Feb. 24, 1978 [JP] Japan ..... 53-21321

[51] Int. Cl.[3] ..... B66B 5/02

[52] U.S. Cl. ..... 187/29 R

[58] Field of Search ..... 187/29

[56] References Cited

U.S. PATENT DOCUMENTS 3,749,204 7/1973 Caputo ..... 187/29

4,027,745 6/1977 Watanabe ..... 187/29

4,030,570 6/1977 Caputo ..... 187/29

*Primary Examiner*—Stanley J. Witkowski

*Assistant Examiner*—W. E. Duncanson, Jr.

*Attorney, Agent, or Firm*—Oblon, Fisher, Spivak, McClelland & Maier

[57] ABSTRACT

A speed control apparatus for elevator system which controls a speed of a cage through a main rope under controlling a motor by a speed control system comprising an acceleration feedback circuit, comprises a detection circuit for detecting a speed or a position of the cage which is vibrated under corresponding a frequency of an outer disturbance to a resonance frequency of the main rope and a command circuit for increasing a gain of the acceleration feedback circuit by the output of the detection circuit.

5 Claims, 5 Drawing Figures

SPEED CONTROL APPARATUS FOR ELEVATOR SYSTEM

BACKGROUND OF THE INVENTION

The present invention relates to an improvement of a speed control apparatus for elevator system.

A speed of a cage in an elevator system is controlled through a long main rope as well-known. It is necessary to stabilize a control system including the main rope system. Various improvements have been proposed for the purpose. FIG. 1 shows one of the conventional system comprising an acceleration feedback circuit.

In FIG. 1, the reference numeral (1) designates a speed command generator; (2) designates a speed control amplifier; (3) designates an acceleration control amplifier; (4) designates a current control amplifier; (5) to (7) respectively designate adders; (8) designates a thyristor converter; (9) designates an armature of a DC motor connected to the thyristor converter (8); (10) designates a shunt winding; (11) designates a DC power source; (12) designates a detector for current of the armature; (13) designates a speed tachometer driven by the armature (9); **(13*a*) designates a speed signal as the output of said speed tachometer; (14) designates an acceleration feedback circuit; (14*a*) designates an acceleration signal as the output of said acceleration feedback circuit; (15) designates a suspension sheave; (16) designates a deflector sheave; (17) designates a main rope; (18) designates a cage; and (19)** designates a counterweight.

The elevator system comprises the speed feedback circuit, the acceleration feedback circuit (14) and the current feedback circuit which control the thyristor converter (8). A DC variable voltage is applied to the armature (9) and the speed of the cage (18) connected to the armature (9) is controlled depending upon the command of the speed command generator (1).

It has been proposed, in said structure, to give a transfer characteristic constant of the acceleration feedback circuit (14) as the following equation in order to inhibit a vibration of the control system by the resonance phenomenon in the main rope system.

$$G = K \cdot \frac{S}{(1 + \frac{1}{\omega_1} S)(1 + \frac{1}{\omega_2} S)} \quad (1)$$

wherein G designates a transfer characteristic constant; K designates a gain; S designates Laplace's operator; $\omega_1$ and $\omega_2$ designate angular velocities.

The angular velocities $\omega_1$, $\omega_2$ are selected as follows.

$$\omega_1 < \omega_r < \omega_2 \quad (2)$$

wherein $\omega_r$ designates an angular velocity corresponding to the resonance frequency of the main rope system.

The control system can be easily stabilized by said structure.

On the other hand, various disturbances for causing vertical vibration of the cage (18) are found in the control system for the elevator. For example, sometimes a motor has torque ripple. The frequency of the torque ripple is proportional to the speed of the cage. When the frequency corresponds to the resonance frequency of the main rope, the cape is vibrated by the torque ripple amplified by the main rope at this speed. This condition is shown in FIG. 2, wherein $V_0$ designates a speed of the cage under corresponding the frequency of the torque ripple of the motor to the resonance frequency of the main rope.

FIG. 2(*a*) shows the speed of the cage and (*b*) shows the acceleration waveform of the cage.

The vibration of the cage in the practical operation is started at the speed $V_1$ (which is slightly lower than $V_0$) and is attenuated at the speed $V_2$ (which is slightly higher than $V_0$).

The acceleration feedback circuit imparts the function for stabilizing the speed control system including the main rope and also imparts attenuation of vibration caused by said outer disturbance. The gain K in the equation (1) for lowering the vibration of the cage by the outer disturbance should be remarkably larger than the gain for stabilizing the system. When the gain is too large, the following disadvantages are caused. Therefore, it has not been attained to decrease the vibration caused by the torque ripple by increasing this gain. That is, the ripple of the tachogenerator is amplified by increasing the gain whereby the cage is vibrated by the ripple of the tachogenerator at the speed $V_0'$ (which is different from $V_0$). In order to prevent such trouble, it has been required to use the expensive low ripple tachogenerator and the driving device thereof. The speed $V_0'$ is the speed of the cage under corresponding the ripple frequency of the tachogenerator to the resonance frequency of the main rope.

SUMMARY OF THE INVENTION

It is an object of the present invention to overcome the above-mentioned disadvantages and to provide a speed control apparatus for elevator system which reduces a vibration of a cage to give comfortable feeling to passenger.

The foregoing and other objects of the present invention have been attained by providing a speed control apparatus for elevator system which controls a speed of a cage through a main rope under controlling a motor by a speed control system comprising an acceleration feedback circuit and which comprises a detection circuit for detecting a speed or a position of said cage which is vibrated under corresponding a frequency of an outer disturbance to a resonance frequency of said main rope and a command circuit for increasing a gain of said acceleration feedback circuit by the output of said detection circuit.

DETAILED DESCRIPTION OF THE PREFERRED EMBODIMENT

Figure 1:
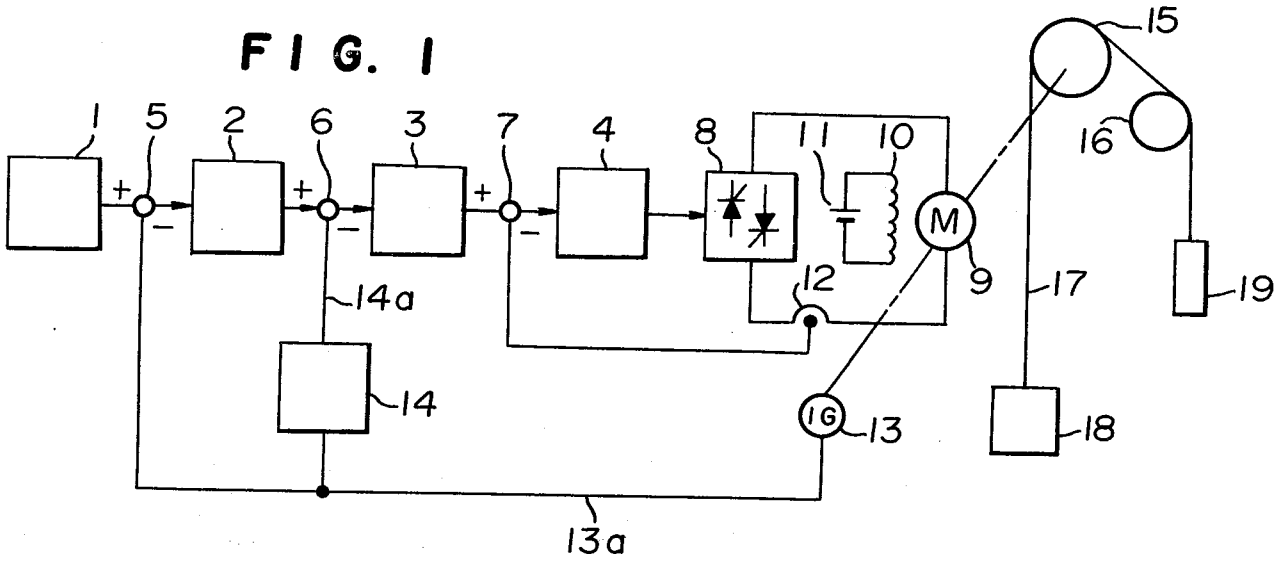
FIG. 1 is a block diagram for a speed control apparatus for elevator system.
Figure 2:
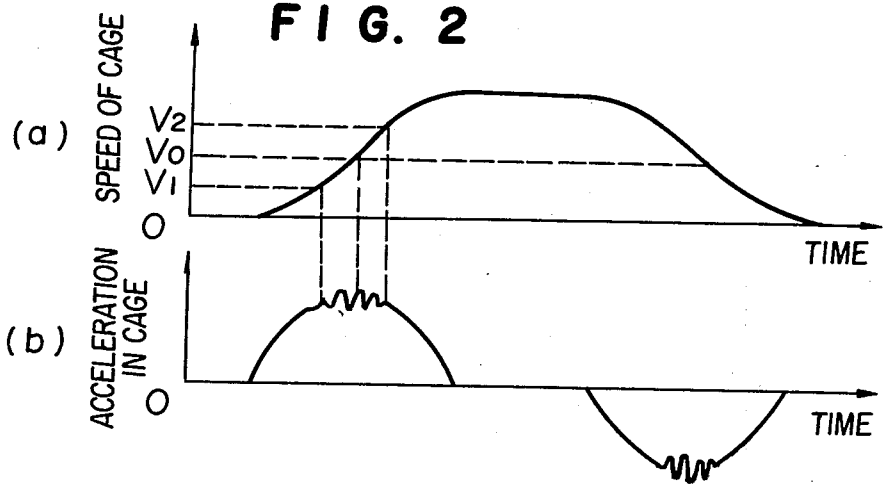
FIG. 2 shows waveforms for speeds of a cage and accelerations in the cage.
Figure 3:
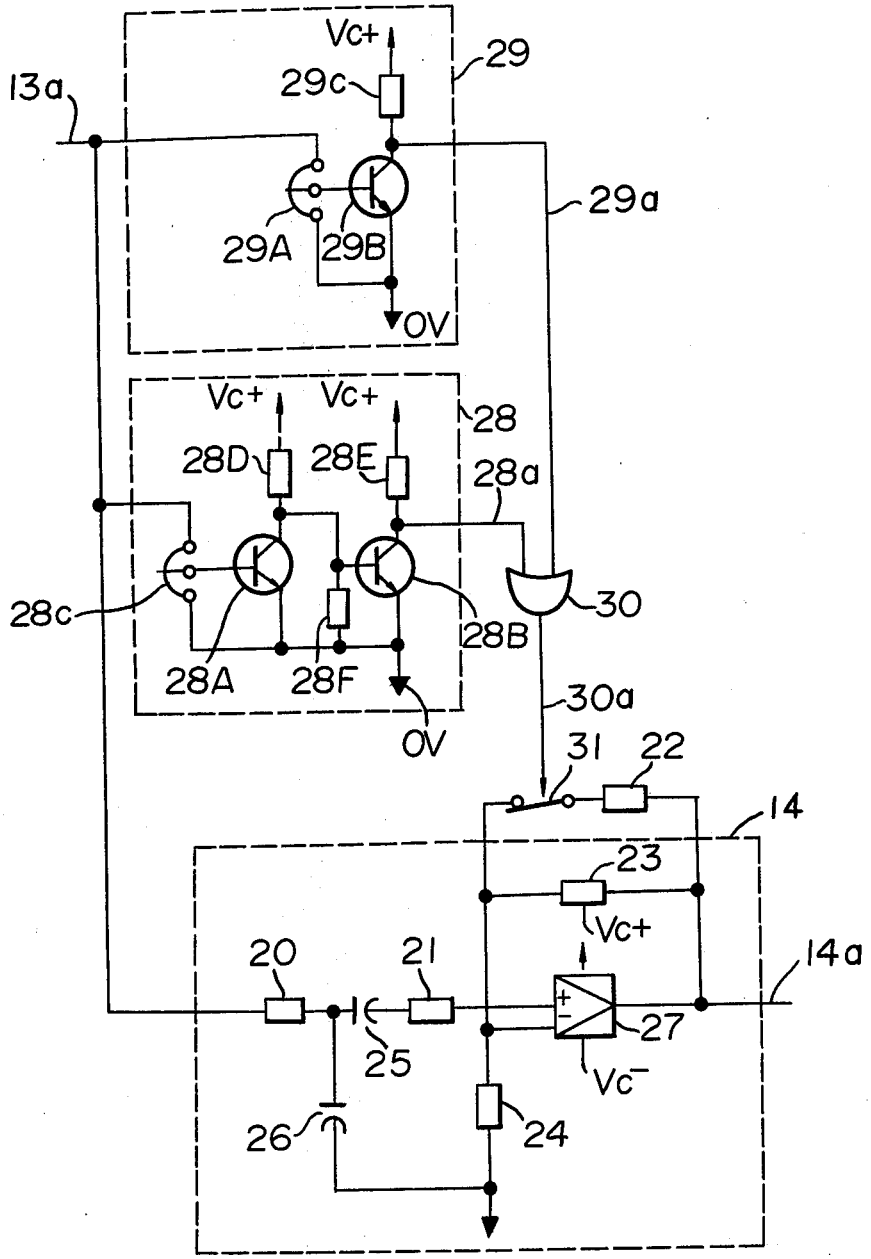
FIG. 3 is a circuit diagram of an acceleration feedback circuit used in FIG. 1 for one embodiment of the speed control apparatus of the present invention.

Referring to FIGS. 1 to 3, one embodiment of the present invention will be illustrated.

In FIG. 3, the reference numerals (20) and (24) respectively represent resistors; (25) and (26) respectively represent capacitors; (27) designates an operation amplifier; (28) designates a speed detection circuit which comprises transistors (28A), (28B); variable resistor (28C) and resistors (28D), (28E), (28F).

When the speed signal (13*a*) is higher than $V_1$ in FIG. 2, the transistor (28A) is turned on and the transistor (28B) is turned off and the output (28*a*) is ⌜1⌟. When the speed signal (13*a*) is lower than $V_1$, the output (28*a*) is ⌜0⌟. The threshold level is adjusted by the variable resistor (28C). The reference numeral (29) designates a speed detector circuit which comprises a variable resistor (29A), a transistor (29B) and a resistor (29C). When the speed signal (13*a*) is higher than $V_2$, the transistor (29B) is turned on and the output (29*a*) is ⌜0⌟. When the speed signal (13*a*) is lower than $V_2$, the output (29*a*) is ⌜1⌟. When an output (30*a*) of an AND gate (30) is ⌜1⌟, a switch (31) is turned off and when the output (30*a*) is ⌜0⌟, the switch (31) is turned on. The other parts are the same with those of FIG. 1. In FIG. 3, the parts surrounded by the broken line corresponds to the conventional acceleration feedback amplifier (14).

The operation of the embodiment will be illustrated.

When a speed of the cage (18) is lower than $V_1$, the output (28*a*) of the speed detection circuit (28) is ⌜0⌟. When a speed is higher than $V_2$, the output (29*a*) of the speed detection circuit (29) is ⌜0⌟. When a speed of the cage (18) is lower than $V_1$ or higher than $V_2$, the output (30*a*) of the AND gate (30) is ⌜0⌟ and the swich (31) is closed. The speed signal (13*a*) is differentiated by the capacitor (25) and amplified by the operation amplifier (27) and output as the acceleration signal (14*a*). The gain is decided depending upon the resistors (22), (23). The acceleration signal (14*a*) is input to the adder (6) in FIG. 1 whereby the vibration caused by the resonation in the main rope system is inhibited in the control system. The control system is stabilized to give the function as that of the conventional one.

When a speed of the cage (18) is higher than $V_1$ and lower than $V_2$, both of the outputs (28*a*), (29*a*) of the speed detection circuits (28), (29) are ⌜1⌟ and ⌜1⌟ and accordingly the output (30*a*) of the AND gate (30) is ⌜1⌟ whereby the speed switch (31) is turned off and the resistor (22) is disconnected and the gain of the acceleration feedback circuit (14) is increased to reduce vibration caused by the torque ripple of the motor. The ripple frequency of the tachogenerator is out of the resonance frequency of the rope whereby the adverse affect of the vibration of the cage is not caused even by increasing the gain of the acceleration feedback circuit.

In said embodiment, the gain is varied by the connection and the disconnection of the resistor (22). It is also possible to vary the gain depending upon a variation of either of a resistance of the resistors (20), (21) or a capacity of the capacitor (25), (26) in the band-pass filter.

Figure 4:
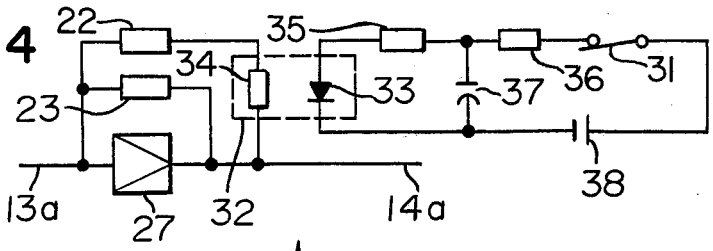
FIG. 4 is a circuit diagram of an important part in FIG. 3 for the other embodiment of the present invention.

FIG. 4 shows the other embodiment on that of FIG. 3. In FIG. 4, a photocoupler (32) comprises a light emission diode (33) and a photoconductive element whose resistance is varied by the irradiation of the light emission diode. The reference numerals (35) and (36) respectively designate resistors (37) designates a capacitor; and (38) designates a DC power source. The other parts are the same with those of FIG. 3.

In the condition shown in FIG. 4, the capacitor (37) is charged and a resistance of the photoconductive element (34) is lowered by the current passed to the light emission diode (33), and the gain in the acceleration feedback circuit (14) is small. When a speed of the cage (18) is higher than $V_1$ and lower than $V_2$, and the speed switch (31) is turned off, the current passed to the light emission diode (33) is gradually decreased by discharged current of the capacitor (37) and a reistance of the photoconductive element (34) is gradually increased. When the discharge is completed, the reistance is constant, whereby the gain is large. When a speed of the cage (18) is lower than $V_1$ or higher than $V_2$, and the speed switch (31) is turned on, the capacitor (37) is charged whereby a resistance of the photoconductive element (34) is gradually decreased and the gain is decreased. Thus, the increase and decrease of the gain are gradually given whereby the variation of the acceleration signal (14*a*) caused by switching the speed switch (31) is smooth and the feeling in the cage (18) is further improved.

Figure 5:
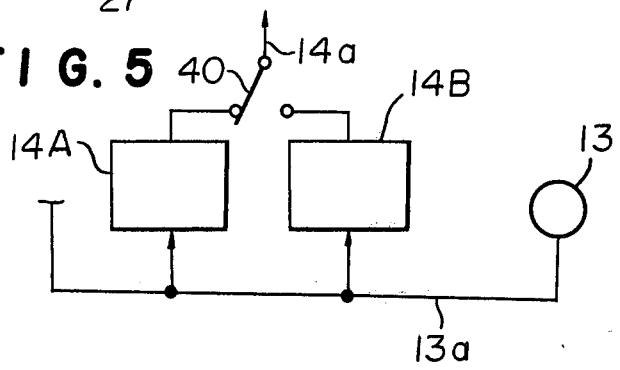
FIG. 5 is a circuit diagram of an important part in FIG. 1 for one embodiment.

FIG. 5 shows the other embodiment of the present invention.

In FIG. 5, the reference numeral (14A) designates an acceleration feedback circuit for lower floor whose constants are given to be suitable for reducing vibration when the cage (18) is in a lower floor and whose structure is the same with that of FIG. 3; and (14B) designates an acceleration feedback circuit for upper floor whose constants are given to be suitable for inhibiting vibration when the cage (18) is in higher floor and (40) designates a switch which is switched to left when the cage (18) is in a lower floor and it is switched to right when the cage (18) is in an upper floor and the switch is operated by a signal of a floor selector etc. (not shown).

As described above, the resonance frequency in the main rope system is varied depending upon the position of the cage in the hoistway. The acceleration feedback circuits (lower floor) (14A) and (upper floor) (14B) are switched depending upon the position of the cage (18) to give constants.

In the embodiments, band-pass filters which are set to the frequency range including the resonance frequency of the main rope, are connected in the acceleration feedback circuit. In accordance with the present invention, the vibration of the cage can be reduced to improve feeling in the cage.

What is claimed is:

1. In a speed control apparatus for an elevator system in which an elevator cage is suspended from a main rope coupled to a motor, wherein a speed control system including an acceleration feedback circuit is employed to control cage speed, the improvement comprising:

said acceleration feedback circuit characterized by a transfer function having a gain factor and including a command circuit for increasing said gain factor; and a detection circuit for detecting cage speed and for generating a gain control signal in the event that the detected cage speed is within a predetermined speed range identified as causing resonance of said rope;

wherein said gain control signal is coupled to said command circuit to increase the gain factor of said acceleration feedback circuit when said detection circuit detects that the cage speed is in said predetermined speed range.

2. In a speed control apparatus for an elevator system in which an elevator cage is suspended from a main rope coupled to a motor, wherein a speed control system including an acceleration feedback circuit is employed to control cage speed, the improvement comprising:

said acceleration feedback circuit characterized by a transfer function having a gain factor and including a command circuit for increasing said gain factor; and a detection circuit for detecting the vertical position of the cage and for generating a gain control signal representative of the detected cage position;

wherein said gain control signal is coupled to said command circuit to increase the gain factor of said acceleration feedback circuit when said detection circuit detects that the cage position is at predetermined positions at which resonance of said main rope occurs.

3. A speed control apparatus for elevator system according to claim 1 or 2, wherein said command circuit comprises means for increasing the gain of said acceleration feedback circuit by disconnecting at least one of plural resistors connected in parallel by the output of said detection circuit.

4. A speed control apparatus for elevator system according to claims 1 or 2 further comprising a light emission diode, and means for controlling a current value of said light emission diode by the output of said detection circuit to change a resistance of photoconductive element by said light emission diode whereby the gain of said acceleration feedback circuit is gradually changed.

5. A speed control apparatus for elevator system according to claim 2 wherein said acceleration feedback circuit comprises a first acceleration feedback circuit for lower floors whose constants are given to be suitable for inhibiting vibration in a case of the lower position of said cage; a second acceleration feedback circuit for upper floors whose constants are given to be suitable for inhibiting vibration in a case of the upper position of said cage; and a switch for switching connection to said first acceleration feedback circuit for lower floors and to said second acceleration feedback circuit for upper floors.

* * * * *